United States Patent [19]

Asai et al.

[11] Patent Number: 4,502,401

[45] Date of Patent: Mar. 5, 1985

[54] ELECTRONIC SEWING MACHINE

[75] Inventors: Yoshimi Asai; Michitaka Takiguchi; Fujio Horie, all of Nagoya, Japan

[73] Assignee: Brother Kogyo Kabushiki Kaisha, Nagoya, Japan

[21] Appl. No.: 494,682

[22] Filed: May 16, 1983

[30] Foreign Application Priority Data

Jun. 4, 1982 [JP] Japan ..... 57-96673

[51] Int. Cl.[3] ..... D05B 3/06; D05B 3/02

[52] U.S. Cl. ..... 112/158 B; 112/158 E; 112/264.1

[58] Field of Search ..... 112/158 B, 158 E, 65, 112/66, 264.1

[56] References Cited

U.S. PATENT DOCUMENTS 4,159,685 7/1979 Wurst ..... 112/158 B 4,409,913 10/1983 Adams et al. ..... 112/158 E X 4,409,915 10/1983 Eguchi et al. ..... 112/158 E 4,413,577 11/1983 Minalga et al. ..... 112/158 E

*Primary Examiner*—Peter Nerbun

*Attorney, Agent, or Firm*—Browdy and Neimark

[57] ABSTRACT

An electronic sewing machine capable of sewing a buttonhole having a circular stitching part. The machine is operative selectively in one of automatic and manual modes. In the automatic mode, bight position of a needle and feed position of a feed dog are automatically controlled according to stored bight and feed data. In the manual mode, the bight and feed positions determined by the stored data are adjusted by a data adjusting circuit. The machine comprises a circuit which supplies the data adjustment circuit with a signal to inhibit the adjustment of at least the feed data for each stitch to be formed in the circular stitching part.

4 Claims, 5 Drawing Figures

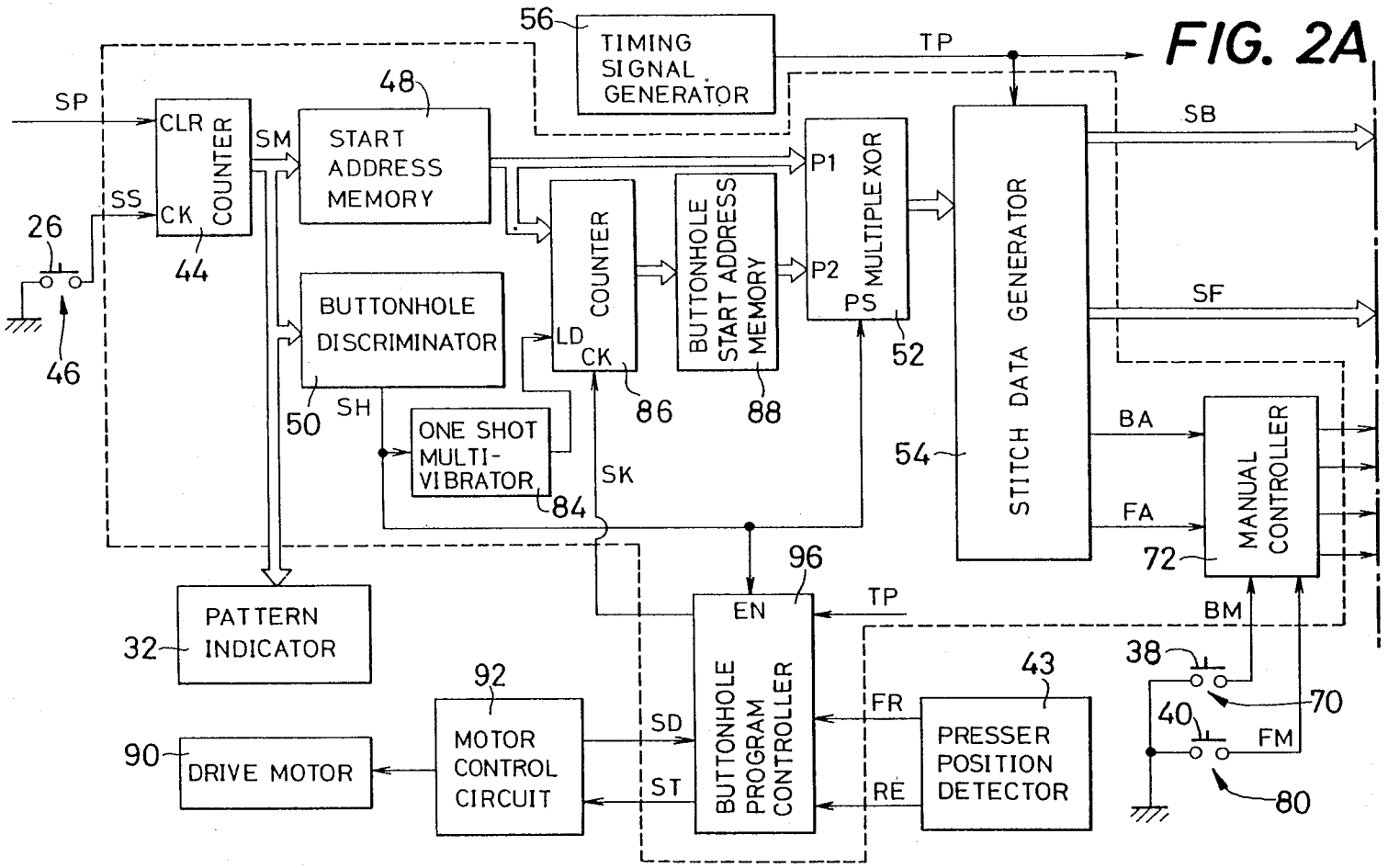
FIG. 2A
TIMING SIGNAL GENERATOR
56
TP
SB
SF
STITCH DATA GENERATOR
54
MANUAL CONTROLLER
72
BA
FA
BM
FM
70
80
38
40
MULTIPLE XOR
52
P1
P2
PS
BUTTONHOLE START ADDRESS MEMORY
88
COUNTER
86
CK
LD
SK
ONE SHOT MULTI-VIBRATOR
84
START ADDRESS MEMORY
48
BUTTONHOLE DISCRIMINATOR
50
SH
SM
COUNTER
44
CLR
CK
SS
SP
26
46
PRESSER POSITION DETECTOR
43
FR
RE
BUTTONHOLE PROGRAM CONTROLLER
96
EN
SD
ST
MOTOR CONTROL CIRCUIT
92
PATTERN INDICATOR
32
DRIVE MOTOR
90

ELECTRONIC SEWING MACHINE

BACKGROUND OF THE INVENTION

The present invention relates generally to a sewing machine capable of sewing buttonholes, specifically eyelet-end buttonholes and other patterns of buttonholes having a circular stitching part. More particularly, the invention is concerned with a sewing machine which permits formation of such buttonholes having a neat, beautiful appearance.

In the art of sewing a predetermined buttonhole having a circular stitching part, a buttonhole sewing machine has been proposed which has a data generator generating bight and feed data representative of each stitch position in timed relation with reciprocation with a needle, and which is operable in one of two modes or conditions selectable through manually operated means: an automatic condition wherein the lateral bight position of the needle and the incremental feed displacement are automatically controlled by the respective bight and feed data from the generator; and a manual condition wherein at least one of the bight position and the feed increment is manually adjusted according to adjustment signals which are generated from a data adjusting circuit to change the bight data and/or feed data from those stored in the generator. In this type of sewing machine, a predetermined buttonhole is sewn exactly from stored stitch data, when in the automatic condition, such that its circular stitching part and side stitching parts connected to the circular stitching part are balanced in size to provide a beautiful appearance, and when the manual condition is established by the manually operated means, the lateral needle jogging and incremental workpiece feeding amounts are manually adjusted to desired values whereby the buttonhole is formed without a trouble of excessively high density of stitches, i.e., stitches which are too close together, or without other troubles which could occur due to changes in workpiece thickness and material or variation in thread thickness.

When the incremental feed of the workpiece is adjusted, the size of a circular stitching part is changed according to adjusted workpiece feed increment while those of side stitching parts are determined by the size of a button. This may cause the formed buttonhole pattern to be unbalanced in size between the circular and side stitching parts, spoiling a neat appearance of the buttonhole dictated by the stored stitch data. When the lateral jogging amount of the needle is adjusted, on the other hand, the circular stitching part tends to be compressed lengthwise of the buttonhole because of limitation in maximum amount of the bight adjustment. This also spoils the appearance of the formed buttonhole pattern and degrades the commercial value of a product having the buttonhole. In addition to the above disadvantages, the known buttonhole sewing machine has been found to have another disadvantage that the adjustment of the pattern width (needle jogging amount) to a smaller value causes reduction in inner diameter of the circular stitching part, which reduction may result in increased chances for cutting stitches when the workpiece is cut to form a buttonhole slit.

SUMMARY OF THE INVENTION

It is accordingly an object of the present invention to provide an electronic sewing machine with a buttonhole sewing capability, which permits adjustments in the size of buttonhole patterns without spoiling their appearance.

According to the invention, there is provided an electronic sewing machine having actuating means for varying a relative position of a needle and a workpiece in accordance with stitch data which influences each stitch of a buttonhole. The sewing machine comprises: data generating means operative in timed relation with reciprocation with the needle for generating stitch data related to each stitch of a predetermined buttonhole having a circular stitching part at its end; adjusting means operative to adjust the stitch data received from the generating means; changeover means capable of switching between an automatic condition and a manual condition to thereby render the adjusting means inoperative and operative, respectively; manually operated means operable to select one of the automatic and manual conditions; control means for selectively generating one of an automatic setting signal and a manual setting signal in accordance with operation of the manual means, the automatic and manual setting signals being effective to set the changeover means in the automatic and manual conditions, respectively; and commanding means for generating an inhibition command in timed relation with generation of the stitch data related to the circular stitching part, the control means being responsive to the inhibition command for stopping the generation of the manual setting signal and generating the automatic setting signal in place of the manual setting signal.

In the electronic sewing machine constructed as described above, the commanding means supplies the control means with commands to inhibit the adjusting means from adjusting at least the feed data of the stitch data for each stitch of the circular stitching part of the buttonhole pattern, thereby maintaining a constant proportion in size of the circular stitching part with respect to the side stitching parts irrespective of the manually established settings of the adjusting means. Thus, the arrangement according to the invention has overcome the conventionally experienced drawbacks including loss of balanced proportion of the buttonhole pattern and resultant degradation of a product carrying the buttonhole.

BRIEF DESCRIPTION OF THE DRAWINGS

The above and other objects, features and advantages of the present invention will become more apparent from reading the following description of the preferred embodiment taken in connection with the accompanying drawings in which:

FIGS. 2A and 2B are schematic block diagrams showing a control circuit for the sewing machine of FIG. 1.

DETAILED DESCRIPTION OF THE PREFERRED EMBODIMENT

Figure 1:
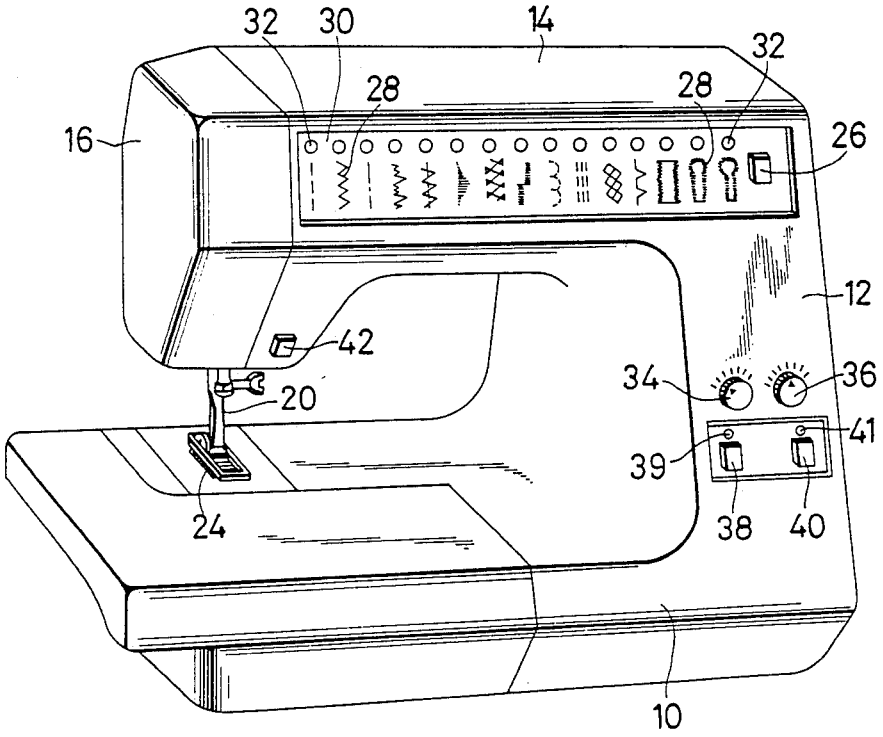
FIG. 1 is a view in perspectve of one embodiment of an electronic sewing machine of the invention capable of sewing buttonholes.

Referring to the accompanying drawings, there is shown in FIG. 1 an electronic sewing machine having a bed 10 from which rises a standard 12. The machine further has a horizontally extending bracket arm 14 which is supported at its one end by the standard 12. The bracket arm 14 terminates in a head 16 which carries at its lower part a needle 20 which is reciprocated endwise or vertically in timed relation with rotations of a machine spindle not shown. The needle 20 is oscillated or jogged laterally or sidewise by a bight actuator 18 described later. On a portion of the bed 10 adjacent to the lowered position of the needle 20, there is provided a feed dog 24 for feeding a workpiece, direction and amount of feed being determined by a feed actuator 22 which is also described later. The needle 20 and the feed dog 24 cooperate to form a desired stitch pattern on the workpiece.

The bracket arm 14 has on its front surface a display plate 30 which carries a pattern selecting button 26, a plurality of pattern indicia 28 representing respective patterns that are selectable by the button 26, and a pattern indicator 32 consisting of plural light emitting diodes (LEDs) located adjacent and corresponding to the pattern indicia 28 to indicate the currently selected pattern through illumination thereof. Further, there are disposed on the front surface of the standard 12 two manually operated control members: a bight adjusting dial 34 for adjusting a lateral width of a stitch pattern (lateral bight position), and a feed adjusting dial 36 for adjusting an incremental feed amount of the workpiece. Below the adjusting dials 34 and 36, there are provided a bight manual-auto button 38 and a feed manual-auto button 40 each of which has two positions: a MANUAL position at which the bight and feed adjusting dials 34, 36 are effective, and an AUTOMATIC position at which the dials 34, 36 are ineffective and the lateral bight position and the incremental feed displacement are automatically determined by stored stitch data for forming a stitch pattern. Light emitting diodes (LEDs) 39 and 41 located above the manual-auto buttons 38 and 40, respectively, will be illuminated when the buttons 38, 40 are set at their MANUAL position. On the lower front surface of the head 16, is provided a start-stop button 42 of alternate-action type whose depressions cause the sewing machine to be started and stopped alternately. The head 16 houses a presser position detector 43 including a lever and a limit switch for detecting a relative position between the needle 20 and a work engaging shoe of a buttonhole presser foot. The detector 43 generates a FRONT EDGE signal FR when the needle 20 is located at the front edge of a buttonhole pattern (at the pattern edge on the operator's side), and a REAR EDGE signal RE when the needle 20 is located on the rear side of the buttonhole pattern (on the side toward which the workpiece is fed).

Figure 2B:
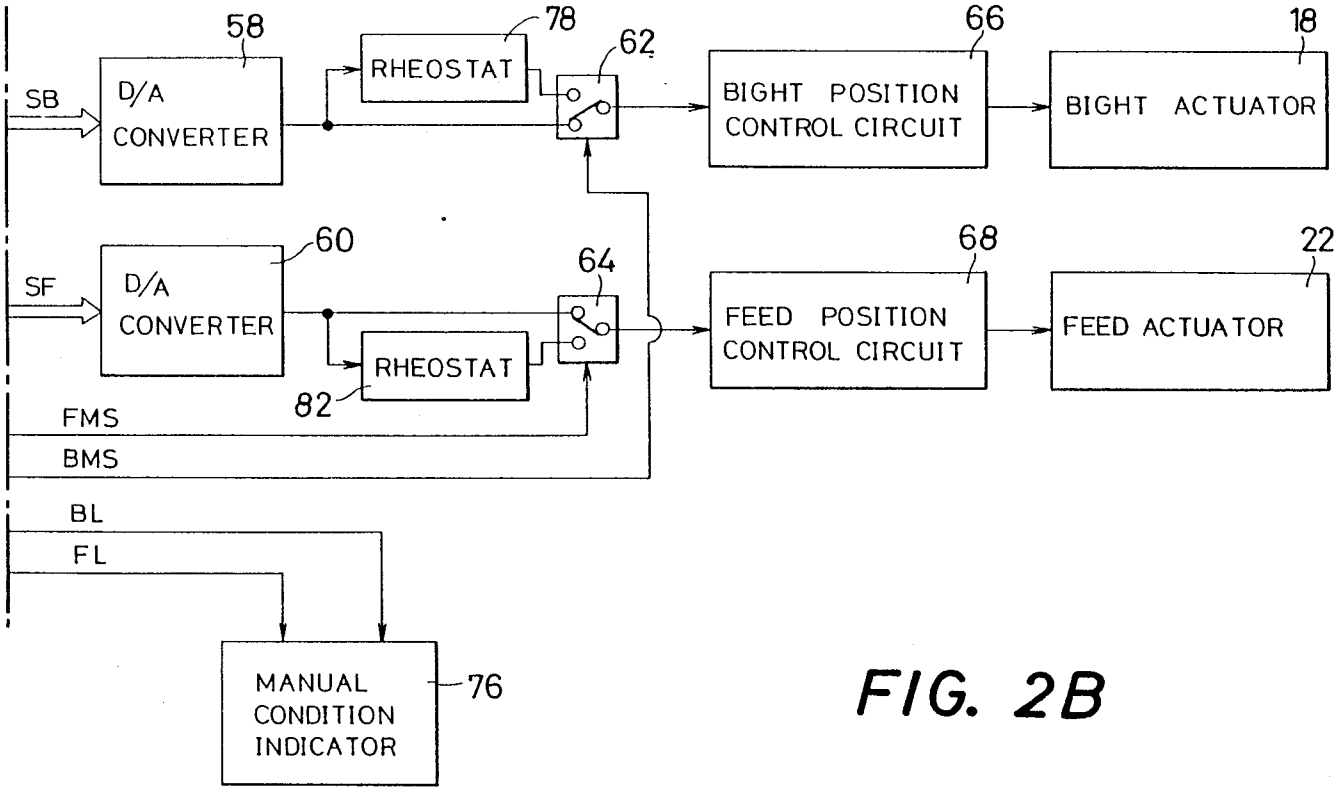

Referring next to FIG. 2 which provides a schematic block diagram showing a control circuit for the sewing machine described above, there is illustrated a counter 44 which is cleared by a POWER-ON signal SP transmitted thereto upon power application to the machine, and which counts a SELECT OPERATION signal SS presented thereto from a switch 46 which is closed to present the signal SS upon each depression of the pattern selecting button 26. The counter 44 generates according to its count a PATTERN CODE signal SM representative of a selected stitch pattern, which signal SM is applied to the pattern indicator 32 to illuminate the LED which corresponds to the indicium 28 of the selected stitch pattern. The signal SM is also applied to a start address memory 48 and to a buttonhole discriminator 50. When the selected stitch pattern is not a pattern of a buttonhole having a circular stitching part, no DISCRIMINATION signal SH is generated from the buttonhole discriminator 50 and consequently a multiplexor 52 selects its input port P1. As a result, a start address corresponding to the PATTERN CODE signal SM is supplied from the start address memory 48 via the multiplexor 52 to a stitch data generator 54 designed as data generating means.

The stitch data generator 54 is well known unit comprising a program counter, and a ROM (read-only memory) which stores plural groups of stitch data representative of selectable stitch patterns including buttonhole patterns having a circular stitching part, examples of the groups of stitch data for such buttonhole patterns being listed in Tables 1 and 2. Each of bight data SB and feed data SF constituting a stitch data for each stitch, comprises an 8-bit digital word which is expressed in hexadecimal digits in Tables 1 and 2.

TABLE 1

| No. | SB | SF | BA | FA |
|---|---|---|---|---|
| 00 | 06 | 00 | 0 | 1 |
| 01 | 06 | 03 | 0 | 1 |
| 02 | 06 | 07 | 0 | 0 |
| 03 | 01 | 00 | 0 | 0 |
| 04 | 00 | 0B | 0 | 0 |
| 05 | 01 | 1D | 0 | 0 |
| 06 | 04 | 0C | 0 | 0 |
| 07 | 02 | 1D | 0 | 0 |
| 08 | 0 | 0B | 0 | 0 |
| 09 | 03 | 1C | 0 | 0 |
| 10 | 0B | 09 | 0 | 0 |
| 11 | 04 | 1A | 0 | 0 |
| 12 | 0E | 05 | 0 | 0 |
| 13 | 04 | 16 | 0 | 0 |
| 14 | 0F | 02 | 0 | 0 |
| 15 | 04 | 13 | 0 | 0 |
| 16 | 0F | 11 | 0 | 0 |
| 17 | 03 | 13 | 0 | 0 |
| 18 | 0E | 13 | 0 | 0 |
| 19 | 02 | 13 | 0 | 0 |
| 20 | 0C | 13 | 0 | 0 |
| 21 | 01 | 13 | 0 | 0 |
| 22 | 0B | 13 | 0 | 1 |
| 23 | 01 | 13 | 0 | 1 |
| 24 | 16 | 00 | 0 | 1 |
| 25 | 16 | 03 | 0 | 1 |
| 26 | 16 | 07 | 0 | 0 |
| 27 | 11 | 00 | 0 | 0 |
| 28 | 00 | 0B | 0 | 0 |
| 29 | 11 | 1D | 0 | 0 |
| 30 | 14 | 0C | 0 | 0 |
| 31 | 12 | 1D | 0 | 0 |
| 32 | 18 | 0B | 0 | 0 |
| 33 | 13 | 1C | 0 | 0 |
| 34 | 1B | 09 | 0 | 0 |
| 35 | 14 | 1A | 0 | 0 |
| 36 | 1E | 05 | 0 | 0 |
| 37 | 14 | 16 | 0 | 0 |
| 38 | 1F | 02 | 0 | 0 |
| 39 | 14 | 13 | 0 | 0 |
| 40 | 1F | 11 | 0 | 0 |
| 41 | 13 | 13 | 0 | 0 |
| 42 | 1E | 13 | 0 | 0 |
| 43 | 12 | 13 | 0 | 0 |
| 44 | 1C | 13 | 0 | 0 |
| 45 | 11 | 13 | 0 | 0 |
| 46 | 1B | 13 | 0 | 1 |
| 47 | 11 | 13 | 0 | 1 |
| 48 | 1B | 00 | 0 | 1 |
| 49 | 0B | 00 | 0 | 1 |
| 50 | 1B | 00 | 0 | 1 |
| 51 | 0B | 00 | 0 | 1 |
| 52 | 1B | 00 | 0 | 1 |
| 53 | 0B | 00 | 0 | 1 |
| 54 | 1B | 00 | 0 | 1 |
| 55 | 1B | 01 | 0 | 1 |
| 56 | 1B | 01 | 0 | 1 |

TABLE 2

| No. | SB | SF | BA | FA |
|---|---|---|---|---|
| 00 | 03 | 00 | 0 | 1 |
| 01 | 03 | 03 | 0 | 1 |
| 02 | 03 | 04 | 0 | 0 |
| 03 | 01 | 00 | 0 | 0 |
| 04 | 00 | 09 | 0 | 0 |
| 05 | 00 | 1B | 0 | 0 |
| 06 | 03 | 0A | 1 | 0 |
| 07 | 01 | 1A | 0 | 0 |
| 08 | 06 | 09 | 1 | 0 |
| 09 | 02 | 19 | 0 | 0 |
| 10 | 09 | 06 | 1 | 0 |
| 11 | 02 | 17 | 0 | 0 |
| 12 | 0A | 04 | 1 | 0 |
| 13 | 02 | 15 | 0 | 0 |
| 14 | 0B | 02 | 1 | 0 |
| 15 | 01 | 14 | 0 | 0 |
| 16 | 0B | 00 | 1 | 0 |
| 17 | 01 | 13 | 0 | 1 |
| 18 | 0B | 13 | 1 | 1 |
| 19 | 13 | 00 | 0 | 1 |
| 20 | 13 | 03 | 0 | 1 |
| 21 | 13 | 04 | 0 | 0 |
| 22 | 11 | 00 | 0 | 0 |
| 23 | 00 | 09 | 0 | 0 |
| 24 | 00 | 1B | 0 | 0 |
| 25 | 13 | 0A | 1 | 0 |
| 26 | 11 | 1A | 0 | 0 |
| 27 | 16 | 09 | 1 | 0 |
| 28 | 12 | 19 | 0 | 0 |
| 29 | 19 | 06 | 1 | 0 |
| 30 | 12 | 17 | 0 | 0 |
| 31 | 1A | 04 | 1 | 0 |
| 32 | 12 | 15 | 0 | 0 |
| 33 | 1B | 02 | 1 | 0 |
| 34 | 11 | 14 | 0 | 0 |
| 35 | 1B | 00 | 1 | 0 |
| 36 | 11 | 13 | 0 | 1 |
| 37 | 1B | 13 | 1 | 1 |
| 38 | 1B | 00 | 1 | 1 |
| 39 | 0B | 00 | 1 | 1 |
| 40 | 1B | 00 | 1 | 1 |
| 41 | 0B | 00 | 1 | 1 |
| 42 | 1B | 00 | 1 | 1 |
| 43 | 0B | 00 | 1 | 1 |
| 44 | 1B | 00 | 1 | 1 |
| 45 | 1B | 01 | 1 | 1 |
| 46 | 1B | 04 | 1 | 1 |

A timing signal generator 56 detects a determinate angular position of the machine spindle (not shown) which is started to rotate upon depression of the start-stop switch 42, and the generator 56 presents a TIMING signal TP to the stitch data generator 54. In synchronism with the TIMING signals TP which are generated synchronously with the rotation of the machine spindle, the stitch data generator 54 produces successive stitch data each consisting of the bight data SB and the feed data SF defining each stitch position, and generates, for each of the stitch positions, a bight command BA and a feed command FA for either permitting or inhibiting an adjustment in size of a stitch pattern to be formed. Thus, the generator 54 provides commanding means for generating an inhibition command (BA, FA). The bight and feed data SB and SF are transmitted to a bight position control circuit 66 and a feed position control circuit 68, respectively, via respective digital-analogue converters 58 and 60 and analogue switches 62 and 64. In response to the bight and feed data, the bight and feed position control circuits 66 and 68 supply controlled outputs of drive power to the bight and feed actuators 18 and 22 to position the needle 20 at a lateral bight position represented by the bight data SB, and to position a feed regulator for obtaining feed increment and direction of the workpiece represented by the feed data SF.

Since the positioning operations discussed above are conducted in synchronism with the TIMING signals TP, a succession of stitches are formed on the workpiece in a pattern selected by the pattern selecting button 26. The analogue switches 62, 64 shown in FIG. 2 are placed in their automatic position or condition, at or in which the size of the stitch pattern to be formed is automatically determined by a series of bight and feed data stored in the stitch data generator 54.

When it is desired to change or adjust the pattern size from that stored in the generator 54, the bight manual-auto button 38 and the feed manual-auto button 40 provided as manually operated means, are individually manipulated to adjust the lateral bight and incremental feed positions, respectively. More specifically stated, the closure of a stitch 70, for example, upon depression of the bight manual-auto button 38 to its manual position, will cause the switch 70 to present a BIGHT MANUAL OPERATION signal BM to a manual controller 72 designed as control means which in turn provides a signal BL to a manual condition indicator 76 including the LEDs 39 and 41, thereby illuminating the LED 39 to indicate that the bight manual-auto button 38 is currently placed in its manual condition. In the meantime, the manual controller 72 regularly receives the bight and feed commands BA and FA, and applies to the analogue switch 62 a BIGHT SETTING signal BMS which is produced based on the feed command BA and the BIGHT MANUAL OPERATION signal BM. The BIGHT SETTING signal BMS sets the analogue switch 62 in the manual condition. As a result, the bight data SB converted into analogue (voltage) signals by the digital-analogue converter 58, is supplied to the bight position control circuit 66 via a rheostat 78 provided as adjusting means. The rheostat 78 is adapted to be controlled by the bight adjusting dial 34, that is, a lateral width of a pattern is adjustable to a desired value according to a setting of the adjusting dial 34. In the same manner as described above, a FEED MANUAL OPERATING signal FM is presented to the manual controller 72 from a switch 80 when it is closed upon depression of the feed manual-auto button 40, and a signal FL is generated from the manual controller 72 to illuminate the LED 46 of the manual condition indicator 76, while at the same time, a FEED SETTING signal FMS which is produced based on the feed command FA and the FEED MANUAL OPERATION signal FM is supplied to the analogue switch 64 which is thereby placed in its manual condition. As a result, the feed data SF which has been converted into analogue signals by the digital-analogue converter 60 is supplied to the feed position control circuit 68 via a rheostat 82 which is controllable by the feed adjusting dial 36, whereby an incremental feed displacement is adjustable to a desired value according to a setting of the adjusting dial 36.

When a stitch pattern selected by the pattern selecting button 26 is a buttonhole pattern having a circular stitching part, the buttonhole discriminator 50 generates a DISCRIMINATION signal SH which is fed through a one-shot multi-vibrator 84 to a counter 86. The signal SH causes the counter 86 to be loaded with a start address from the start address memory 48 which corresponds to the selected buttonhole pattern. In the meantime, the DISCRIMINATION signal SH is applied also to the multiplexor 52 to cause the same to select its input port P2. In consequence, the count of the counter 86 is supplied to a buttonhole start address memory 88 which then presents to the stitch data generator 54 through the multiplexor 52 a start address signal to designate a start address for the first stitching part of the buttonhole pattern.

Described in more detail, a buttonhole pattern consists of a plurality of successive stitching parts including a circular stitching part at one end of the pattern. Plural blocks of stitch data corresponding to the plural stitching parts are sequentially retrieved or extracted from the stitch data generator 54 according to start address signals for the individual blocks of stitch data. These start address signals are supplied to the stitch data generator 54 from the buttonhole start address memory 88 according to the count of the counter 86 which is caused to increment or count up by SEQUENCE signals SK fed from a buttonhole program controller 96 which is permitted to operate by the DISCRIMINATION signal SH. The buttonhole program controller 96 which has a counter to count the TIMING signals TP, receives from a motor control circuit 92 a MOTOR START signal SD representative of a start of the drive motor 90, which signal SD permits the controller 96 to start its sequential operation. The SEQUENCE signals SK presented to the counter 86 from the program controller 96 are produced based on the count of the counter of the controller 96 and on the FRONT EDGE and REAR EDGE signals FR and RE from the presser position detector 43.

In the event, for example, the buttonhole pattern represented at the extreme right-hand side position on the display plate 30 of FIG. 1 is selected by the pattern selecting button 26, the counter 86 is loaded with the first address signal for the selected buttonhole pattern, and the address signal for the block of stitch data related to the first stitching part is supplied from the start address memory 88 to the stitch data generator 54 through the multiplexor 52. In this condition, the FRONT EDGE signal FR is present with the needle 20 located at the front edge of the buttonhole pattern (at the edge on the operator's side).

Figure 3:
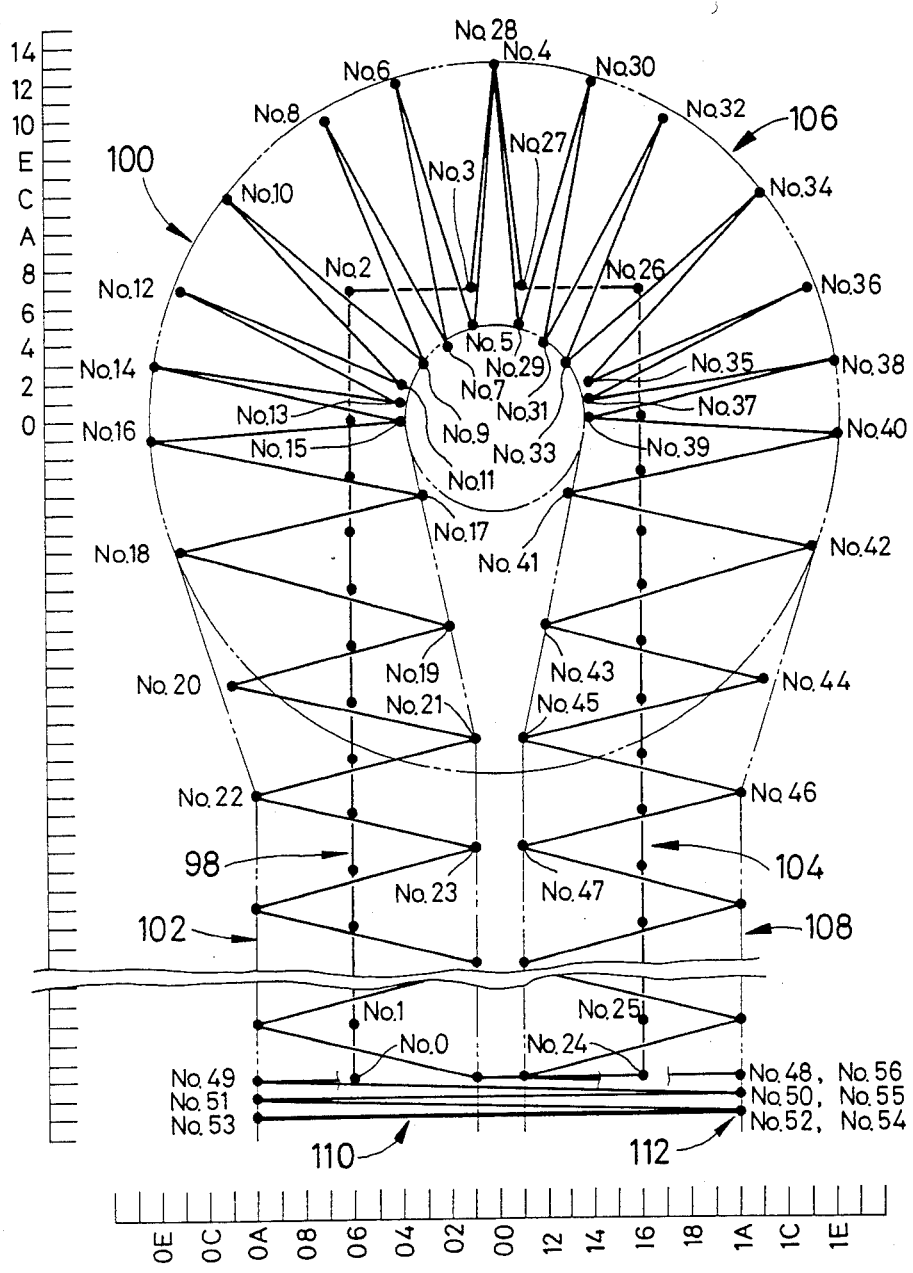
FIGS. 3 and 4 are respectively diagrammatic views illustrating two different patterns of buttonholes sewn on the machine of FIG. 1.

When a drive motor 90 is started with the drive power applied thereto from the motor control circuit 92 upon depression of the start-stop button 42, a stitch data No. 0 of Table 1 is generated from the stitch data generator 54, and the stitch No. 0 is first formed as shown in FIG. 3. After the formation of the stitch No. 0, a SEQUENCE signal SK is supplied from the buttonhole program controller 96 to the counter 86, whereby the next start address signal is presented from the start address memory 88 to the generator 54. As a result, a stitch data No. 1 is repeatedly generated from the generator 54 until the next start address signal is presented, and plural stitches No. 1 are successively formed to provide a left side straight stitching part 98 as depicted in FIG. 3. When the needle 20 has moved to a line which is normal to the feed direction and passes the center of the circular stitching part, the presser position detector 43 generates the REAR EDGE signal RE which causes the buttonhole program controller 96 to present a SEQUENCE signal SK to the counter 86, whereby the next start address signal for the next stitching part, i.e., a left semicircular stitching part 100, is supplied from the start address memory 88 to the stitch data generator 54. Thus, stitch data No. 2 and subsequent listed in Table 1 are sequentially extracted from the generator 54, in synchronization with the TIMING signals TP, to form the left semicircular stitching part 100. The buttonhole program controller 96 counts the TIMING signals TP, and when the count has reached a predetermined value (20), presents another SEQUENCE signal SK to the counter 86 to load the stitch data generator 54 with the next start address signal. Stated differently, the stitch data Nos. 2 through 21 are sequentially extracted from the stitch data genrator 54 before the predetermined value (20) is counted, and the left side semicircular stitching part 100 of FIG. 3 is formed according to the extracted data. When the said next start address signal is supplied to the generator 54, stitch data Nos. 22 and 23 in Table 1 are alternately generated from the generator 54 in a repeated fashion until the FRONT EDGE signal FR is produced, whereby a left side zigzag stitching part 102 is formed as shown in FIG. 3.

Upon receipt of the FRONT EDGE signal FR by the buttonhole program controller 96, another SEQUENCE signal SK is supplied to the counter 86, and the next start address signal is given by the buttonhole start address memory 88 to the stitch data generator 54. In consequence, a stitch data No. 24 is generated and the corresponding stitch No. 24 is formed as shown in FIG. 3. Successively, events of operations similar to those discussed above take place, beginning with loading the generator 54 with the next start address signal which is supplied upon generation of a SEQUENCE signal SK from the buttonhole controller 96. This causes a next stitch data No. 25 of Table 1 to be repeatedly generated from the generator 54 until the REAR EDGE signal RE is produced, whereby there is formed a right side straight stitching part 104 similar to the left side straight stitching part 98. The REAR EDGE signal RE will cause the generator 54 to be loaded with the next start address signal, generating stitch data No. 26 and subsequent sequentially to form a right semicircular stitching part 106 similar to the left semicircular stitching part 100. When the predetermined count (20) is reached in the buttonhole program controller 96, another SEQUENCE signal SK is applied to the counter 86 and stitch data Nos. 46 and 47 are alternately executed repeatedly until the FRONT EDGE signal FR is generated. Thus, a right side zigzag stitching part 108 is provided. Upon generation of the FRONT EDGE signal FR, stitch data Nos. 48 through 53 are sequentially extracted from the generator 54 to form a bar tacking part 110. In the meantime, the number of stitches (6 stitches in this embodiment) to be contained in the bar tacking part 110 is counted in the buttonhole program controller 96. When the predetermined count (6) is reached, a SEQUENCE signal SK is produced to load the generator 54 with the next start address signal, to execute the following stitch data Nos. 54, 55 and 56 for forming a back stitching part 112. After the number of stitches (3) in the back stitching part 112 is counted in the buttonhole program controller 96, a MOTOR STOP signal ST is presented from the controller 96 to the motor control circuit 92 and the drive motor 90 is automatically stopped. Thus, the entire portion of the buttonhole of FIG. 3 is sewn.

Figure 4:
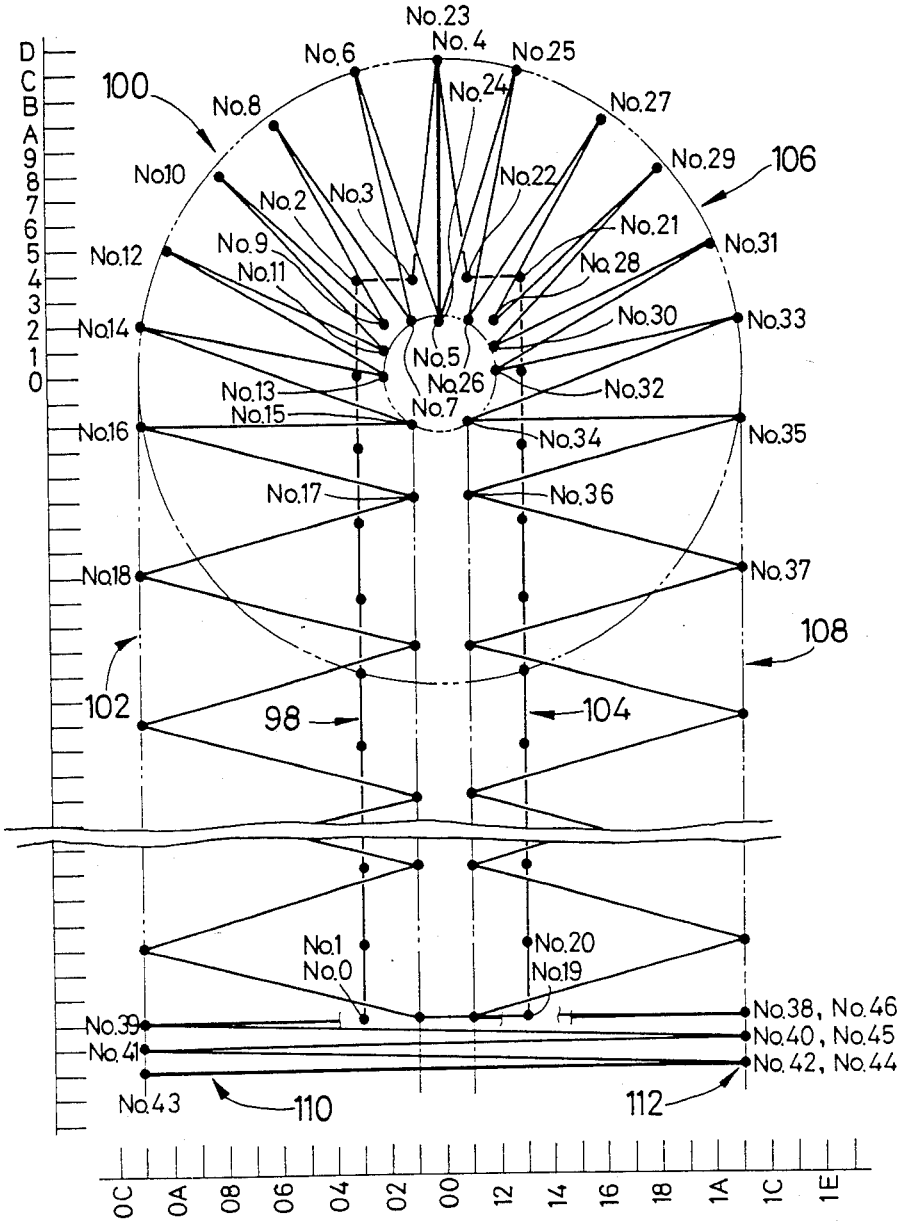

In the case where the pattern selecting button 26 has selected the buttonhole pattern represented at the position next to the extreme right-hand side position on the display plate 30 in FIG. 1, the selected buttonhole is sewn in the similar manner. More specifically, upon the first address signal being supplied to the stitch data generator 54, a stitch data No. 0 is generated and the corresponding stitch No. 0 is formed as shown in FIG. 4. Subsequently, a stitch data No. 1 is generated repeatedly in synchronism with the TIMING signals TP until the REAR EDGE signal RE is produced, so that the left side straight stitching part 98 is formed. In the next step, the following stitch data are sequentially extracted from the generator 54 until a predetermined number (15) is counted in the buttonhole program controller 96, i.e., the stitch data Nos. 2 through 16 are executed to form the left semicircular stitching part 100. After the predetermined count (15) is reached, stitch data Nos. 17 and 18 are alternately generated repeatedly until the FRONT EDGE signal FR is presented, whereby the left side zigzag stitching part 102 is sewn. The FRONT EDGE signal FR causes the generator 54 to generate the next stitch data No. 19, and subsequently the following stitch data No. 20 repeatedly until the REAR EDGE signal RE is produced, thereby forming the right side straight stitching part 104. Then, the stitch data No. 21 and subsequent are sequentially generated until a predetermined number (15) is counted in the buttonhole program controller 96, that is, the stitch data Nos. 21 through 35 are executed to form the right semicircular stitching part 106. When the predetermined number of stitches (15) has been counted, stitch data Nos. 36 and 37 are alternately executed until the FRONT EDGE signal FR is generated, to form the right side zigzag stitching part 108. Upon generation of the FRONT EDGE signal FR, stitch data Nos. 38 through 43 are sequentially executed until a predetermined number (6) has been counted, to form the bar tacking part 110. The following stitch data are generated until a predetermined number (3) has been counted, i.e., data Nos. 44 through 46 are executed to form the back stitching part 112, and the drive motor 90 is automatically brought to a stop.

As indicated in Tables 1 and 2, each stitch data includes one-bit bight and feed commands BA and FA, so that a manual adjustment of at least the incremental feed is inhibited for each stitch position in the semicircular stitching parts 100 and 106. More specifically, the value "0" of the bight or feed command BA or FA in Tables 1 and 2 represents the inhibition of the adjustment of the bight or feed position, and the value "1" represents the permission of the adjustment. The manual controller 72 is adapted to produce the FEED SETTING signal FMS based on the bight command BA and the BIGHT MANUAL OPERATION signal BM, and produce the FEED SETTING signal FMS based on the feed command FA and the FEED MANUAL OPERATION signal FM. Therefore, the analogue switches 62, 64 are operated in response to the bight and feed commands BA and FA which are produced for either inhibition or permission of the adjustment for each stitch, even while the bight manual-auto button 38 and/or the feed manual-auto button 40 are placed in their manual condition, that is, the manual condition indicator 76 is illuminated indicating the selection of the manual condition.

In the sewing of the buttonhole of FIG. 3, for example, the adjustment of the lateral bight position of the needle 20 is inhibited for all stitch data while that of the incremental feed displacement is permitted for only the sets of stitch data (No. 0, No. 1, Nos. 22 through 25, and Nos. 46 through 56) which are not related to the formation of the semicircular stitching parts 100 and 106. Thus, the adjustment of the bight data SB as well as the feed data SF are inhibited for all stitches in the semicircular stitching parts 100 and 106, whereby the buttonhole pattern of FIG. 3 is formed such that the two semicircular stitching parts 100 and 106 cooperate to form a stitching part of truly circular configuration irrespective of the settings of the bight and feed adjusting dials 34 and 36. This inhibition of the adjustment prevents otherwise possible distortion and resultant spoiling of appearance of the circular stitching part.

Similarly, in the formation of the buttonhole of FIG. 4, the adjustment of the feed data SF is inhibited for the stitches which form the exterior circle defining the outer circumference of the semicircular stitching parts 100, 106, and that of the bight and feed data SB and SF is inhibited for the stitches which forms the interior circle defining the inner circumference of the stitching parts 100, 106. Thus, the settings of the dials 34 and 36 will not affect the configuration of the buttonhole pattern of FIG. 4, i.e., a beautiful, truly circular stitching part is constituted by the semicircular stitching parts 100 and 106 which do not suffer geometrical distortion and resultant spoiling of its appearance.

Further, in the buttonhole pattern of FIG. 4, the adjustment of the bight data is inhibited for the stitches located adjacent to the inner circumference of the semicircular stitching parts 100, 106, and also for the stitches located on the inner sides of the left and right side zigzag stitching parts 102, 108. Therefore, a constant width of a cutting space is maintained between the stitching parts 102, 108 irrespective of the setting of the bight adjusting dial 34, and chances for cutting stitches during formation of a buttonhole slit are eliminated. It is noted that the numbers located adjacent to dots in FIGS. 3 and 4 represent stitches which are formed from the respective stitch data numbered in Tables 1 and 2.

While the present invention has been described in its preferred embodiment, it is to be understood that the invention is not limited thereto but may be otherwise embodied.

It is possible, for example, that the bight and feed commands BA and FA which are stored together with predetermined stitch data in the previous embodiment, are produced by means of counting the number of stitches formed after initiation of a sewing cycle.

While, in the preceding embodiment, the MOTOR STOP signal ST to stop the drive motor 90 is adapted to be generated when the predetermined number of stitches of the back stitching part 112 has been counted, it will be appreciated that the MOTOR STOP signal ST be produced in response to an end code signal which is generated when the last block of stitch data stored in the stitch data generator 54 for the back stitching part 112 has been executed.

Further, it will be obvious that the components within a block of dashed lines in FIG. 2 are totally or partially provided in the form of a so-called microcomputer.

It is to be understood that other changes and modifications may be made in the invention without departing from the scope of the invention defined by the appended claims.

What is claimed is:

1. An electronic sewing machine having actuating means for varying a relative position of a needle and a workpiece in accordance with stitch data which influences each stitch of a buttonhole, comprising:

data generating means, operative in timed relation with reciprocation of said needle, for generating stitch data related to each stitch of a predetermined buttonhole having a circular stitching part at its end;

adjusting means operative to adjust the stitch data received from said generating means;

changeover means capable of switching between an automatic condition and a manual condition to thereby render said adjusting means inoperative and operative, respectively;

manually operated means operable to select one of said automatic and manual conditions;

control means for selectively generating one of an automatic setting signal and a manual setting signal in accordance with operation of said manually operated means, said automatic setting signal and said manual setting signal being effective to set said changeover means in said automatic condition and said manual condition, respectively;

commanding means for generating an inhibition command in timed relation with generation of said stitch data related to said circular stitching part; and said control means being responsive to said inhibition command for stopping the generation of said manual setting signal and generating said automatic setting signal in place of said manual setting signal.

2. An electronic sewing machine having stitch forming instrumentalities including a laterally joggable needle and a work feeding mechanism, and actuating means for imparting movement to said instrumentalities in accordance with bight data and feed data which influence each stitch of a buttonhole, comprising:

data generating means, operative in timed relation with reciprocation of said needle, for generating bight data and feed data related to each stitch of a predetermined buttonhole having a circular stitching part at its end;

bight adjusting means operative to manually adjust the bight data received from said generating means;

feed adjusting means operative to manually adjust the feed data received from said generating means;

bight switch means and feed switch means connected with said bight adjusting means and said feed adjusting means, respectively, each of said two switching means being capable of switching between an automatic condition and a manual condition to thereby supply the data from said data generating means directly and through said adjusting means to said actuating means, respectively;

manually operated means operable to select one of said automatic and manual conditions;

control means for selectively supplying each of said two switch means with one of an automatic setting signal and a manual setting signal in accordance with operation of said manually operated means, said automatic setting signal and said manual setting signal being effective to set each of said two switch means in said automatic condition and said manual condition, respectively;

commanding means for generating a feed inhibition command in synchronism with generation of said feed data related to said circular stitching part; and said control means being responsive to said feed inhibition signal for stopping the supply of said manual setting signal and supplying said automatic setting signal to said feed switch means.

3. An electronic sewing machine according to claim 2, wherein said data generating means generates bight data and feed data related to each stitch of a predetermined buttonhole having a circular stitching part at its end and two side stitching parts which are connected to and narrower than the circular stitching part, said commanding means generating a bight inhibition command in synchronism with generation of said bight data related to each stitch of all the stitching parts of said buttonhole, and said control means being responsive to said bight inhibition command for stopping the supply of said manual setting signal and supplying said automatic setting signal to said bight switch means.

4. An electronic sewing machine according to claim 2, wherein said data generating means generates bight data and feed data related to each stitch of a predetermined buttonhole having at its end a circular stitching part defined by an interior circle and an exterior circle and two side stitching parts which are connected to and equal in width to the circular stitching part, said commanding means generating a bight inhibition command in synchronism with generation of said bight data related to each stitch adjacent to said interior circle, and said control means being responsive to said bight inhibition command for stopping the supply of said manual setting signals and supplying said automatic setting signal to said bight switch means.

* * * * *